US005808535A

United States Patent [19]

Delucia

[11] Patent Number: 5,808,535

[45] Date of Patent: Sep. 15, 1998

[54] HIGH FREQUENCY WATER COOLED INDUCTION HEATING TRANSFORMER

[75] Inventor: Victor E. Delucia, Valley Village, Calif.

[73] Assignee: L. C. Miller Company, Monterey Park, Calif.

[21] Appl. No.: 757,457

[22] Filed: Nov. 27, 1996

[51] Int. Cl.[6] ..... H01F 27/10; H01F 27/30

[52] U.S. Cl. ..... 336/62; 336/175; 336/195; 336/223

[58] Field of Search ..... 336/55, 57, 60, 336/62, 195, 175, 223, 61

[56] References Cited

U.S. PATENT DOCUMENTS 1,820,018 8/1931 Gebhard ..... 336/62
4,134,091 1/1979 Rogers ..... 336/195

*Primary Examiner*—Thomas J. Kozma

[57] ABSTRACT

A high frequency water cooled transformer for coupling a power source to an induction heating coil and which serves to convert the output of the power source into values appropriate for the induction heating coil, and to match the impedance of the power source with the impedance of the heating coil for maximum power transfer efficiency. The primary of the transformer is adapted to be connected to the power source and the secondary is adapted to be connected to the induction heating coil. The transformer includes a secondary formed of two parallel self-supporting elongated open-ended hollow electrically conductive cylindrical members. A pair of electrically conductive terminal blocks are respectively mounted on one of the ends of the cylinders and electrically connected to the cylinders. The primary winding is wound longitudinally through the two secondary cylinders, and the ends of the primary winding are connected to appropriate terminal pins. An apertured disc is mounted at each end of the cylindrical secondary members to receive the wires of the primary winding and to form cooling chambers in each of the cylindrical secondary members. The discs are sealed to the wires of the primary winding and to the cylindrical secondary members to render the cooling chambers waterproof. Means is provided for circulating a coolant through the cooling chambers in the cylindrical secondary members and through the terminal blocks. Each secondary cylindrical member is surrounded by a plurality of ferrite toroid cores, and the cores are sealed to the outer surfaces of the secondary cylindrical members by an appropriate heat conductive potting compound.

5 Claims, 5 Drawing Sheets

HIGH FREQUENCY WATER COOLED INDUCTION HEATING TRANSFORMER

BACKGROUND OF THE INVENTION

The invention relates to an improved high frequency water cooled transformer for coupling a power source to an induction heating coil of the type described in co-pending application Ser. No. 08/685,517, filed Jul. 24, 1996 in the name of the present inventor and assigned to the present assignee. The power source may be any commercial type. For example, a typical power source has an output of 0–5.0 kilowatts at a frequency of 10–50 kHz, and a voltage of 350 volts, RMS with a maximum current of 210 amperes, RMS, or 73,500 volt-amperes, RMS. This power source is an inverter based, solid state, high frequency type which provides infinite control over the range of 0–5 kW, and it enables its output frequency to be set between 10 and 50 kHz, automatically, depending upon coil inductance and load.

The transformer of the invention, like the transformer of the co-pending application, serves to convert the output of the power source into values appropriate for an induction heating coil and to match the impedance of the power source with the impedance of the coil for maximum transfer efficiency. To this end, the transformer of the invention, for example, steps down the output voltage of the power source by a ratio of 4:1, and it is capable of supplying up to 840 amperes, RMS to the induction heating coil. The primary of the transformer of the invention is connected to the power source and the secondary is connected to the induction heating coil. The induction heating coil may be water cooled and may be connected to the secondary of the transformer by a clamp of the type described, for example, in U.S. Pat. No. 5,410,134, which is assigned to the present assignee.

It is an objective of the present invention to provide such a high frequency water cooled transformer which is simpler and less expensive to construct than the water cooled transformer of the co-pending application, and yet is dependable in operation, and in which the working temperatures and power losses are maintained at a minimum.

A further objective of the present invention is to provide such a water cooled high frequency transformer which is relatively compact and light in weight.

Yet another objective of the invention is to provide such a water cooled high frequency transformer which may be manufactured without requiring highly skilled workers or special tools, materials or equipment.

DETAILED DESCRIPTION OF THE ILLUSTRATED EMBODIMENT

Figure 1:
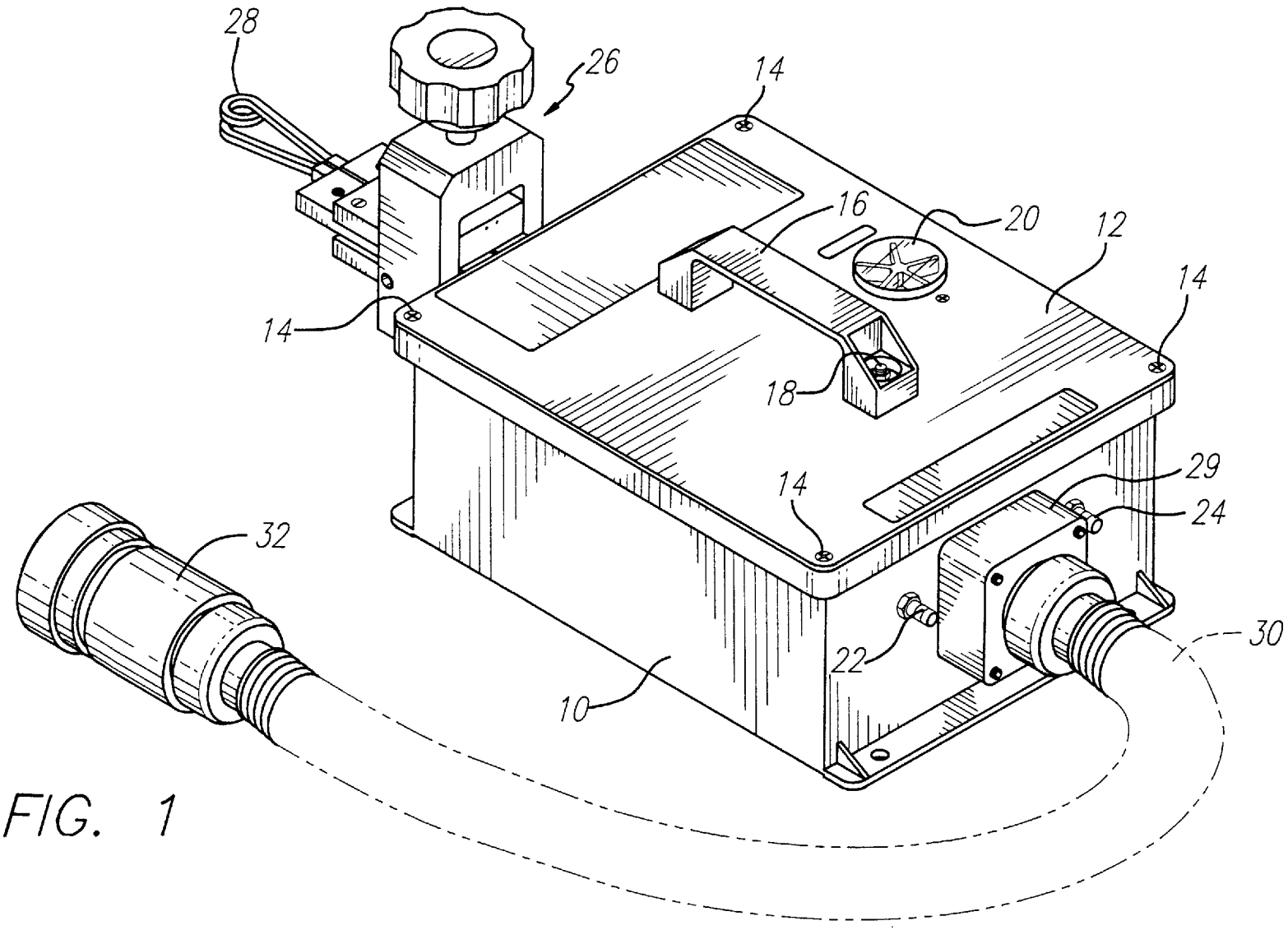
FIG. 1 is a perspective view of the high frequency water cooled transformer of the present invention enclosed in a portable casing, and also showing a cable for connecting the transformer to an appropriate power source, together with a clamp for supporting an appropriate water cooled induction heating coil on the transformer and for connecting the secondary of the transformer to the induction heating coil.

As shown in FIG. 1, the water cooled high frequency transformer of the invention is mounted in an appropriate casing 10 which has a cover 12 mounted on its open top by appropriate screws 14. A handle 16 is mounted on the cover 12 by screws, such as screw 18. A flow indicator 20 is mounted in the casing to be visible through the cover to indicate whether or not cooling water is flowing in the transformer assembly, this being effectuated by rotation of the indicator whenever water is flowing.

Water or other appropriate coolant is introduced into the transformer through a first coupling 22 at one end of the casing, and the circulating water flows out of the casing through a second coupling 24.

A clamp 26 is mounted on the other end of the casing, and it serves to connect the secondary of the transformer to an induction heating coil 28, and also removably to support the coil on the transformer casing. As mentioned above, the clamp 26 may be of the type described in U.S. Pat. No. 5,410,134. This patent issued Apr. 25, 1994, and it is assigned to the present assignee.

An electrical socket 29 is mounted on the other end of the casing for receiving the plug of a power cable 30. The power cable 30 serves to connect the primary of the transformer to an appropriate power source by way of a plug 32 at its other end.

Figure 4:
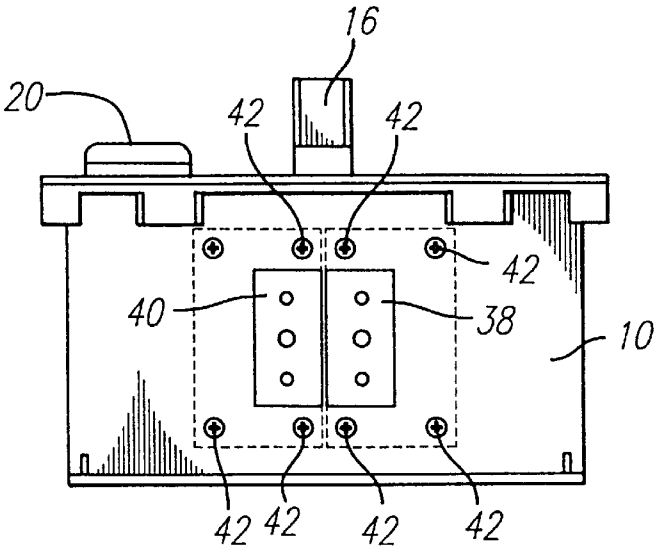
FIG. 4 is a front elevational view of the transformer of FIGS. 2 and 3 with the induction coil clamp removed to reveal terminal blocks for connecting the clamp to the secondary of the transformer.
Figure 5:
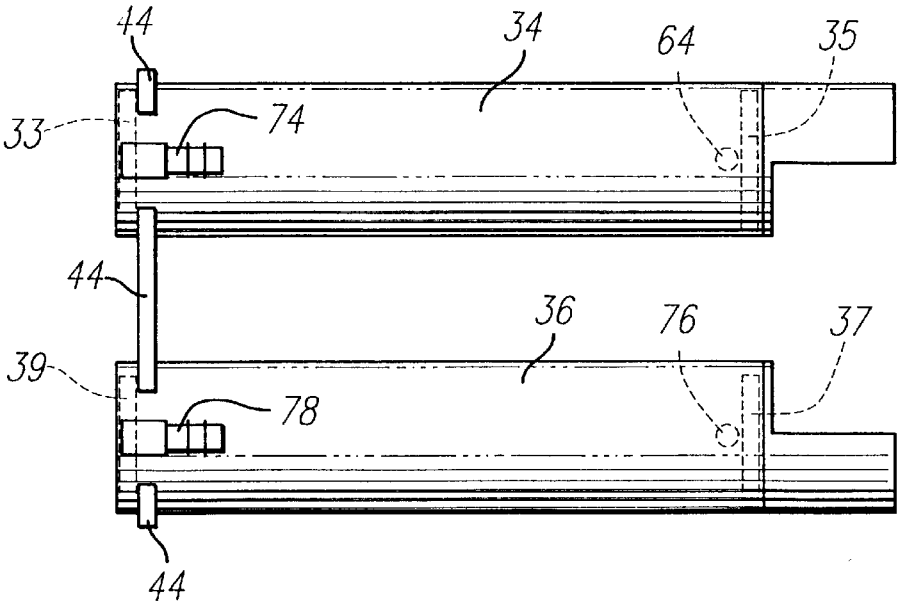
FIG. 5 is a top plan view of certain of the internal components of the transformer removed from the casing.
Figure 6:
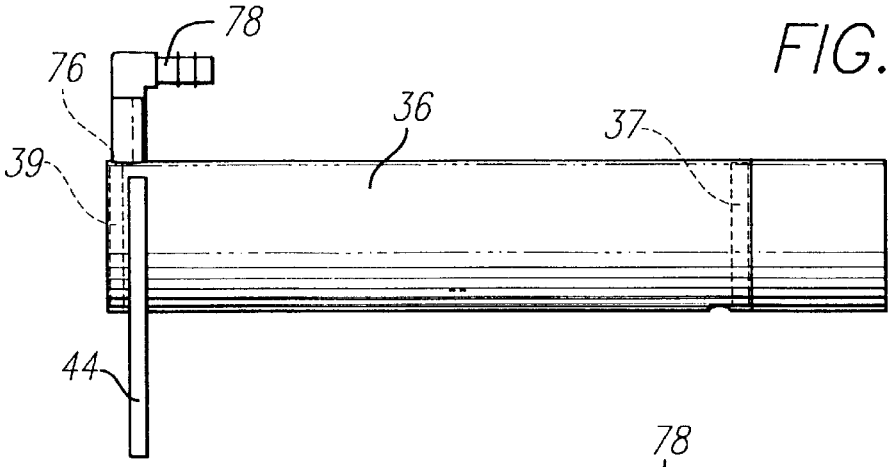
FIG. 6 is a side elevational view of the internal components of the transformer shown in FIG. 5.
Figure 7:
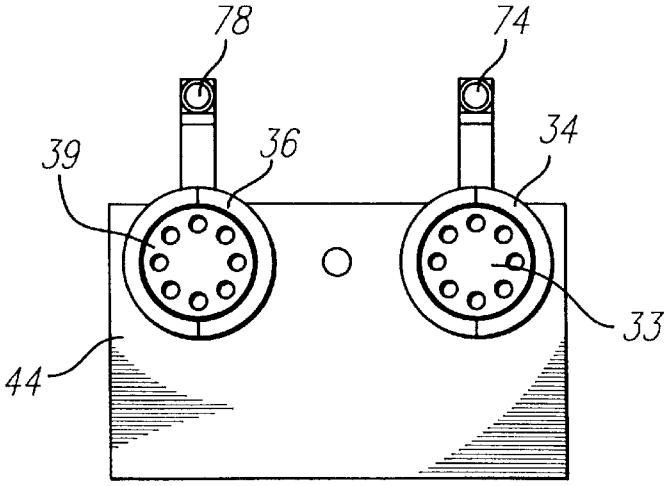
FIG. 7 is a front elevational view of the internal components shown in FIGS. 6 and 7.
Figure 8:
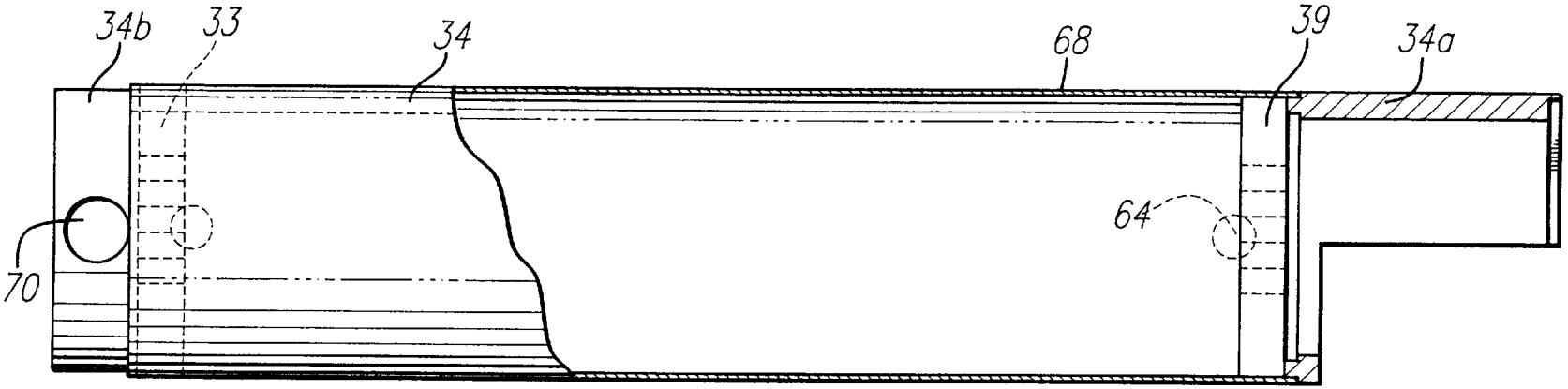
FIG. 8 is a top plan view of one of two secondary elements of the transformer, partly in section and on an enlarged scale with respect to the previous views.
Figure 9:
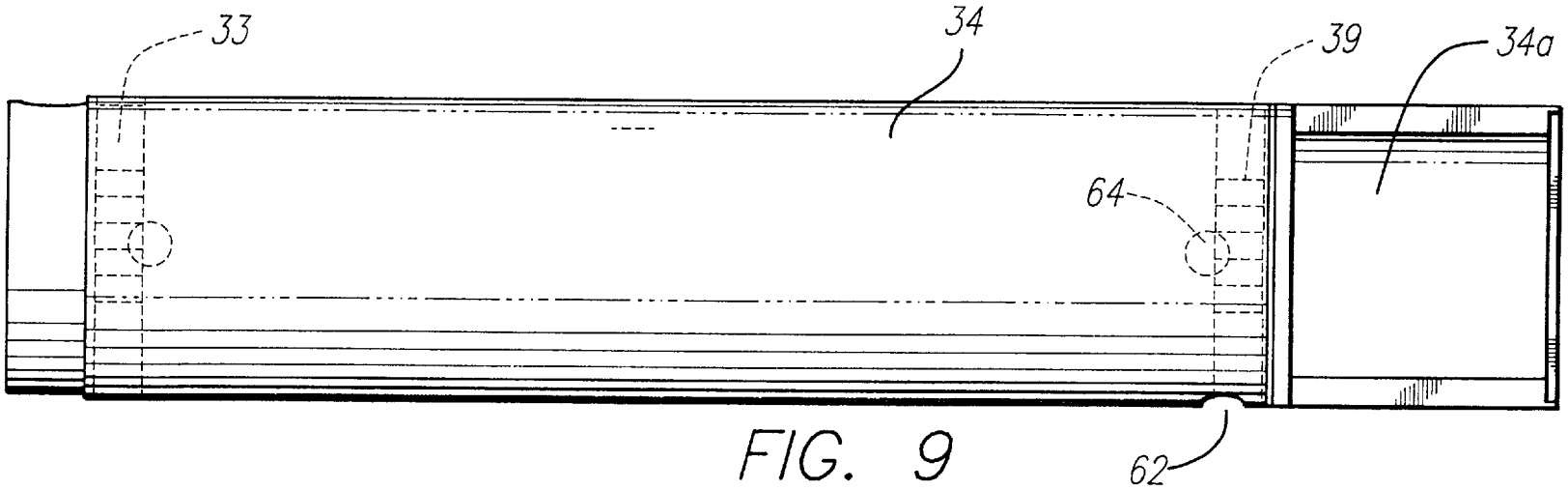
FIG. 9 is a side elevational view of the secondary element of FIG. 8.

The transformer of the invention includes a secondary which is formed of two rigid elongated open-ended copper cylinders 34, 36 (FIG. 5–7). The righthand ends of the secondary cylinders 34, 36 are respectively connected to copper blocks 38 and 40 (FIG. 4) which are separated from one another and which are mounted on the rear wall of casing 10 by screws 42. These blocks serve to support the clamp 26 (FIG. 1) and to connect the secondary cylinders 34 and 36 to the clamp. The blocks have passages therein to permit the circulation of cooling water, as will be described. The lefthand ends of the secondary cylinders are mounted in casing 10 by a bracket 44 (FIGS. 5, 6 & 7). The lefthand ends of the secondary cylinders are connected together by the bracket 44 which is formed of an electrically conductive material, and this bracket also serves as a spacer for the cylinders. As shown in FIG. 5, the righthand ends of the secondary cylinders are notched to receive a wire-type primary winding 48 (FIG. 2).

Figure 2:
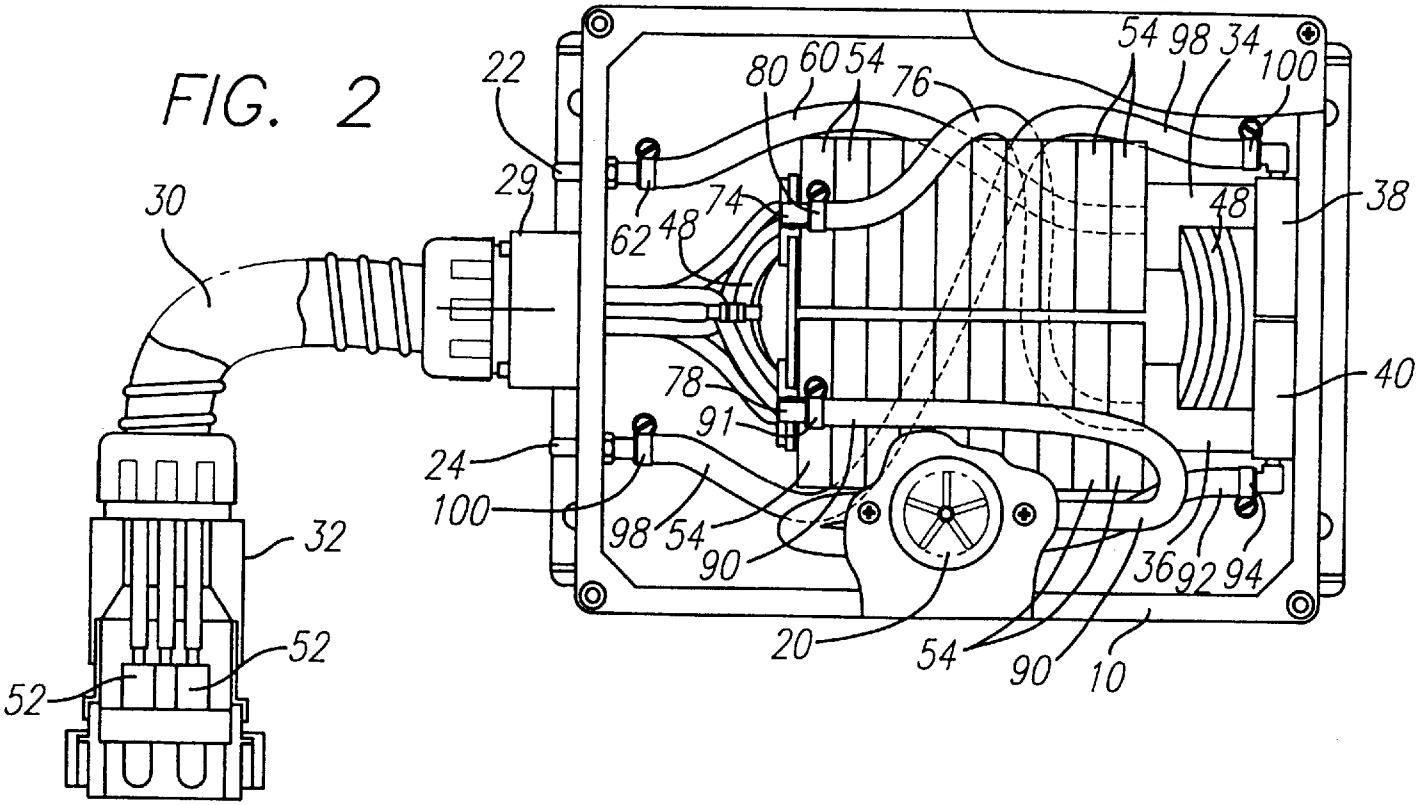
FIG. 2 is a top plan view of the transformer of FIG. 1 with a portion of the cover removed to reveal certain internal components.
Figure 3:
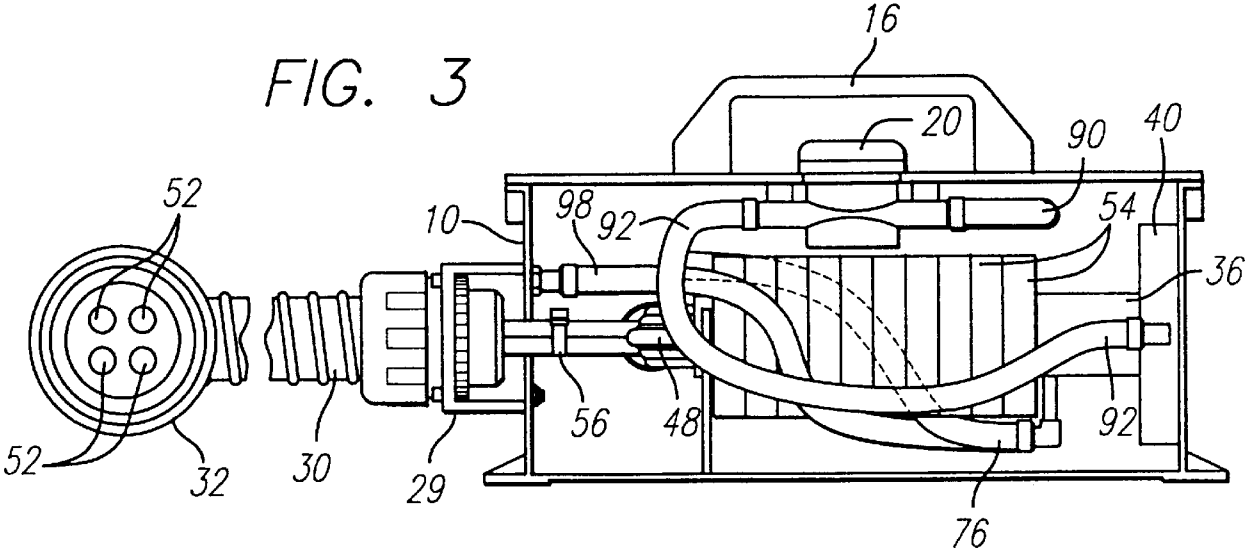
FIG. 3 is a side elevational view of the transformer of FIG. 2 with the side panel removed, likewise to reveal certain internal components.

The primary winding 48 is wound longitudinally through the two secondary cylinders 34, 36 as shown in FIG. 2, and the ends of the primary winding extend into socket 29 and are held together by a clamp 56 (FIG. 3). The ends of the primary winding are each connected to two of the terminal pins 52 of socket 32. Apertured disc-shaped spacers 33, 35, 37, and 39 are mounted in each of the secondary cylinders at the respective ends thereof as shown in FIGS. 5, 7, 8 and 9. The individual wires of the primary winding extend through the apertures in the various spacers. The diameter of each hole in the spacers is made slightly less than the outer diameter of the corresponding primary wire. Each spacer is formed of an appropriate resilient plastic material, such as Neoprene. Each spacer is coated and sealed to the internal surface of the corresponding cylinder 34, 36 by any appropriate epoxy or other adhesive. Moreover, each primary wire is preferably coated by an appropriate plastic such as Teflon to assure a waterproof seal between the wires and the coated spacers. The spacers form chambers within the secondary cylinders 34 and 36, and the construction is such that the chambers serve as water-type cooling chambers in each of the cylinders. An epoxy layer may be applied to the outer surfaces of each of the spaces 33, 35, 37 and 39 to assure that there will be no leakage from the coolant chambers within the secondary cylinders 34 and 36.

Each secondary cylinder 34, 36 is surrounded by a plurality of coaxially mounted ferrite toroid cores 54 (FIG. 2). The annular spaces between the toroid cores and the secondary cylinders 34, 36 are filled with an appropriate commercially available thermal conductive epoxy potting compound.

The inlet coupler 22 for the water coolant, as shown in FIG. 2, is attached to a tube 60 by a clamp 62. Tube 60 extends into a port 64 at one end of the secondary cylinder 34 (FIG. 5). The coolant water flowing through the tube 60 flows into port 64 which communicates with the coolant chamber in the interior of secondary cylinder 34. The coolant water flows through the coolant chamber and out through a port 70 (FIG. 8) to a coupler 74 (FIG. 5). The secondary cylinder 36 is similarly constructed, and it includes a port 76 communicating with an output coupler 78 (FIGS. 5 and 6).

Water flowing from the inlet 22 through the tube 60 flows into the cooling chamber in secondary cylinder 34 and out through coupler 74 to a tube 76 which is attached to the coupler by a clamp 80. Tube 76 extends to an inlet port 77 at the righthand end of the secondary cylinder 36 and the coolant flows through the tube 76 into the cooling chamber in the secondary cylinder 36 and out through coupler 78. The water flowing out of the secondary cylinder 36 flows through a tube 90 which is clamped to coupler 78 by a clamp 91. The water in tube 90 flows through the flow indicator 20 and from the flow indicator through a tube 92 which is clamped to an inlet of the block 40 by a clamp 94. The water flowing through the tube 92 flows through passages in the block 40 and in the block 38 and then out through a tube 98 which is clamped to an outlet from the block 38 by a clamp 100. The water flowing through the tube 98 flows out the coupler 24 to which the tube is clamped by a clamp 100.

Accordingly, when pressurized coolant is applied to the coupler 22, the coolant flows through tube 60 into the cooling chamber in secondary cylinder 34 and out from the other end of the cylinder to tube 76 which causes the fluid to be introduced to the righthand end of the secondary cylinder 36, then through the cooling chamber in the second cylinder 36 and out the other end of the secondary cylinder to tube 90. The coolant then flows through the flow indicator 20 and out tube 92, and through the blocks 40 and 38 and back to the outlet coupler 24.

In the foregoing manner, all of the components of the transformer are efficiently cooled by the coolant water, with the heat conductive potting compound conducting heat from the toroid cores 54 to the cooled surfaces of the secondary cylinders, so that the heat generated within the transformer is efficiently dissipated.

The invention provides, therefore, a relatively simple high frequency transformer which is water cooled in an efficient manner.

While a particular embodiment of the invention has been shown and described, modifications may be made. It is intended in the claims to cover all modifications which come within the true spirit and scope of the invention.

I claim:

1. A high frequency transformer comprising: a secondary having a pair of elongated cylindrical self-supporting electrically conductive members mounted in spaced relationship on respective parallel axes; a primary winding having a plurality of wire turns wound longitudinally through said hollow electrically conductive cylindrical secondary members; a pair of magnetic core members surrounding respective ones of said cylindrical secondary members in coaxial relationship therewith, each of said electrically conductive cylindrical secondary members forming a cooling chamber; a plurality of apertured disc-shaped spacer members respectively positioned at each end of each of said cylindrical secondary members for receiving and separating the wire turns of said primary winding and for forming said cooling chamber in each of said cylindrical secondary members; and means for circulating a coolant through the cooling chamber in each of said hollow cylindrical secondary members.

2. The high frequency transformer defined in claim 1, in which each of said magnetic core members is formed of a plurality of ferrite toroid shaped members coaxially mounted adjacent to one another.

3. The high frequency transformer defined in claim 2, and which includes a heat conductive potting compound interposed between said ferrite core members and said cylindrical secondary members to seal said ferrite core members to said cylindrical secondary members.

4. The high frequency transformer defined in claim 1, in which said primary winding comprises a plurality of wire turns.

5. The high frequency transformer defined in claim 4, and which includes the wire turns of said primary winding sealed to said apertures in each of said disc-shaped spacer members and an epoxy sealant formed on each of said disc-shaped spacers members to seal the disc-shaped spacer member to the secondary cylindrical members so as to render the cooling chamber water proof.

* * * * *